United States Patent [19]

Lind

[11] 4,445,911

[45] May 1, 1984

[54] METHOD OF CONTROLLING OPERATION OF AN ELECTROSTATIC PRECIPITATOR

[75] Inventor: Leif Lind, Copenhagen, Denmark

[73] Assignee: F. L. Smidth & Co., Cresskill, N.J.

[21] Appl. No.: 331,012

[22] Filed: Dec. 15, 1981

[30] Foreign Application Priority Data

Dec. 17, 1980 [GB] United Kingdom ..... 8040463

[51] Int. Cl.[3] ..... B03C 3/04; B03C 3/68

[52] U.S. Cl. ..... 55/2; 55/105; 55/139; 323/903

[58] Field of Search ..... 55/2, 4, 105, 139; 323/903

[56] References Cited

U.S. PATENT DOCUMENTS

| | | | |
|---|---|---|---|
| 3,622,839 | 11/1971 | Abrams et al. | 55/105 |
| 3,745,749 | 7/1973 | Gelfand | 55/105 |
| 3,959,715 | 5/1976 | Canning | 55/105 |
| 3,984,215 | 10/1976 | Zucker | 55/2 |
| 4,152,124 | 5/1979 | Davis | 55/105 |
| 4,267,502 | 5/1981 | Reese et al. | 55/105 |
| 4,311,491 | 1/1982 | Bibbo et al. | 55/2 |
| 4,354,860 | 10/1982 | Herkiotz et al. | 55/105 |

FOREIGN PATENT DOCUMENTS

| | | | |
|---|---|---|---|
| 680837 | 2/1964 | Canada | 55/105 |
| 1080979 | 5/1960 | Fed. Rep. of Germany | 323/903 |
| 2208724 | 6/1974 | France . | |
| 1154972 | 6/1969 | United Kingdom . | |

*Primary Examiner*—David L. Lacey
*Attorney, Agent, or Firm*—Pennie & Edmonds

[57] ABSTRACT

A method is disclosed for controlling the DC voltage of an electrostatic precipitator having electrodes energized by a preset DC voltage in which the preset DC voltage has pulses superimposed thereon. According to the method, the pulses are periodically turned off. Thereafter, the corona discharge current caused by the DC voltage is measured and compared against a preset value. Thereafter, the DC voltage is adjusted in dependence upon the measured corona discharge current by it being increased or decreased depending upon whether the discharge current is lower or higher than the preset value.

26 Claims, 5 Drawing Figures

METHOD OF CONTROLLING OPERATION OF AN ELECTROSTATIC PRECIPITATOR

TECHNICAL FIELD

The invention relates to a method of controlling the operating parameters of an electrostatic precipitator which is energized by voltage pulses superimposed on a DC-voltage.

BACKGROUND ART

It is a documented fact that the performance of conventional two-electrode precipitators can be improved by pulse energization where high voltage pulses of suitable duration and repetition rate are superimposed on an operating DC-voltage.

The improvements obtained by pulse energization as compared with conventional DC energization are caused by the combined effect of the following advantages:

Higher peak voltage without excessive sparking, and therefore improved particle charging.

More effective extinguishing of sparks and better suppression of incipient back corona.

The corona discharge current can be controlled by pulse repetition frequency and pulse amplitude. This allows the precipitator current to be reduced below the back corona onset level in case of high resistivity dust without reducing precipitator voltage.

For short duration pulses, the corona discharge takes place well above the corona onset level for constant DC voltage and is suppressed during the remaining part of the pulse by space charges. This results in a more uniformly distributed corona discharge along the discharge electrode.

Furthermore, corona discharges from short duration pulses are less influenced by variations in gas and dust conditions. This improves the internal current distribution of a separately energized field.

Stable corona discharge is obtainable from surfaces with larger diameter curvatures. This permits the use of large diameter discharge wires or rigid type discharge electrodes with comparatively short and blunt tips, reducing the risk of discharge electrode failures.

The improvements found in precipitator performance, resulting in increased particle migration velocity, particularly for high resistivity dusts, permit reduction of the collection area for new installations or improvement of the efficiency of existing installations without increase of collection area.

For practical application, automatic control of any precipitator energization system is of major importance in order to secure optimum performance under changeable operating conditions and to eliminate the need for supervision of the setting of the electrical parameters.

With conventional DC energization, commonly used control systems regulate precipitator voltage and current, and in general terms, the strategy is aimed at giving maximum voltage and current within the limits set by spark-over or back corona conditions. The possibilities of different strategies are extremely limited, since the precipitator voltage is the only parameter which can be regulated independently.

In contradistinction, pulse energization allows independent control of the following parameters:

1. DC Voltage level
2. Pulse voltage level

3. Pulse repetition frequency
4. Pulse width

The possibility of combining the setting of several parameters enables development of highly efficient control strategies, if the phenomena taking place in the precipitator are measured and interpreted correctly.

As it is important for the efficiency of a precipitator that the DC-voltage is maintained as high as possible, a primary objective is to control this voltage to its highest permissible level, which level is determined by the permissible corona discharge current at the DC-level between pulses.

The need for a control is due to the fact that the corona discharge current is not only a function of the DC-voltage, but is also influenced by the actual application and variations in the conditions of the gas and of the dust to be precipitated.

I have invented a method of controlling these parameters to obtain an optimum functioning of a pulse energized precipitator. It will be apparent, however, that the method might also be used for conventional DC energized precipitators, only omitting the steps in the procedure related to application of pulse voltages.

DISCLOSURE OF THE INVENTION

The present invention relates to a method of controlling the DC-voltage in an electrostatic precipitator having electrodes energized by pulses superimposed upon a preset DC-voltage, which comprises, periodically eliminating the pulses and thereafter measuring the corona discharge current in the precipitator, comparing the measured corona dicharge current against a predetermined value, and adjusting the DC-voltage in dependence upon the measured corona discharge current.

Thus, according to the invention the DC-voltage is controlled by turning off the pulses periodically; measuring the corona discharge current caused by the DC-voltage; comparing this measured value with a set value; and increasing or decreasing the DC-voltage depending on whether the measured value of the discharge current is lower or higher than the set value respectively.

During the periods with the pulses turned off the DC-voltage may be temporarily increased with a predetermined amount and maintained elevated during the measuring of the corona current. This temporary increase may start a little before the pulses are turned off so that the pulses are not turned off until the temporary increase of the DC-voltage is established. In this manner the period in which the precipitator efficiency is reduced due to the turning off of the pulses, may be minimized as this turning off can be postponed until immediately before the measuring of the corona discharge current.

After a measurement at a temporary increased DC-level the corona discharge current caused by the pulses being turned on again towards the end of the measuring period wil actually lower the DC-level to its desired level.

The increase or decrease of the original DC-voltage due to the controlling can be determined by a closed loop control regulating the DC-voltage to create a predetermined corona current or the original DC-voltage may be increased or decreased by a preselected discrete value.

BRIEF DESCRIPTION OF THE DRAWINGS

Preferred embodiments of the invention will now be described with reference to the accompanying drawings wherein.

BEST MODE FOR CARRYING OUT THE INVENTION

Figure 1:
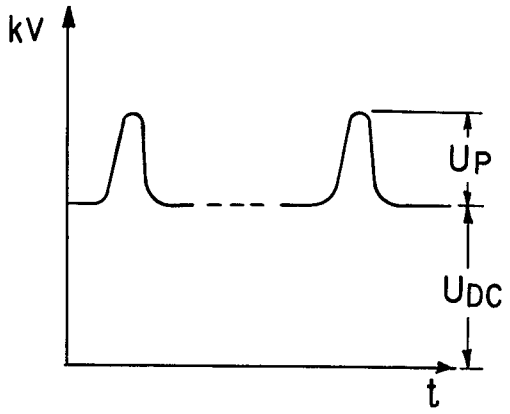
FIG. 1 illustrates schematically pulses superimposed on a DC-voltage for energizing an electrostatic precipitator.

Referring to FIG. 1 there is shown schematically voltage pulses of height (i.e., amplitude) $U_P$-superimposed on a DC-voltage $U_{DC}$ for energizing an electrostatic precipitator. FIG. 1 shows the voltage on the discharge electrode as a function of time. This voltage will usually be negative, so what is depicted here is the numeric (i.e., absolute) value of the voltage. In the following explanation voltage levels and increases or decreases accordingly refer to the numerical voltage.

In order to fully benefit from the pulse technique, it is important that the DC-level is maintained as high as possible, that is, slightly below the corona extinction voltage, or at a voltage creating a certain corona current depending on actual application.

For applications with high resistivity dust, optimum performance is obtained with the DC-voltage maintained slightly below the corona extinction voltage. The object is to extinguish completely the corona discharge after each pulse. Combined with suitably long intervals between pulses, this allows the DC field to remove the ion space charge from the interelectrode spacing, before the next pulse is applied, and thus permits high pulse peak voltages without sparking. Furthermore, it allows full control of the corona discharge current by means of pulse height and repetition frequency.

In applications with lower resistivity dust, a certain amount of corona discharge at the DC-voltage level is advantageous to secure a continuous current flow through the precipitated dust.

Figure 2:
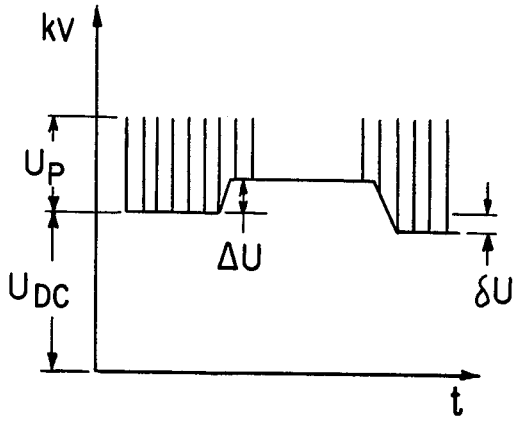
FIG. 2 is a voltage/time diagram illustrating schematically the progress of a DC-corona measuring period on a shortened time scale.

In one embodiment, the DC-voltage level is determined by the so-called "finger-method", illustrated in FIG. 2. With a certain time interval (selectable for example between 1 and 10 min), the DC voltage is continually increased to a plateau by a certain amount $\Delta U$ (selectable, for example, between 0 and 10kV). The voltage pulses (shown here as spikes) are reduced to maintain the DC plus pulse voltage at a constant level. When the desired DC level is reached, the voltage pulses are switched off and a circuit for measuring corona discharge current is activated. The measurement is performed during an even number of half periods of the power frequency to eliminate the effect of displacement current. The control compares the measured value with a set value (selectable for example between 0 and the rated precipitator current). If the limit value is exceeded, the DC-voltage is reset to a level a certain amount $\delta U$ (selectable, for example, between 0.2 and 1kV) below the DC value prior to the measurement (i.e., as shown). If the set value is not exceeded, the DC level is reset to a value the same amount above the original setting. After the measurement is completed, the pulse voltage is turned on and maintained at a level corresponding to a fixed maximum value of DC plus pulse voltage. In the intervals between the finger or plateau voltages, the DC-voltage is maintained unchanged, provided that spark-over between pulses does not occur. The values set forth hereinabove in the parentheses are based on experiences from practical embodiments.

Figure 3:
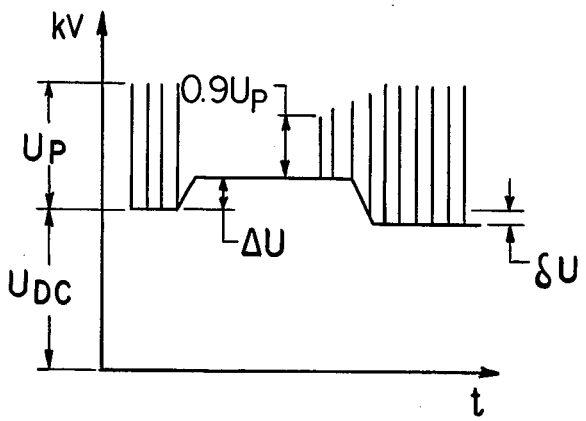
FIG. 3 is an alternate embodiment illustrating schematically in the form of a voltage/time diagram the progress of a DC-corona measuring period on a shortened time scale.

In another embodiment, illustrated in FIG. 3, the same procedure is used with the following modifications:

The pulse voltage is turned off before the DC voltage is raised.

After completion of current measurement, the pulse voltage is turned on at a level a certain amount (selectable, for example, between 0.3kV and 6kV) below the value prior to its temporary increase and a special circuit raises the pulse voltage level exponentially to the value prior to the corona discharge current measurement within 5 seconds.

Figure 4:
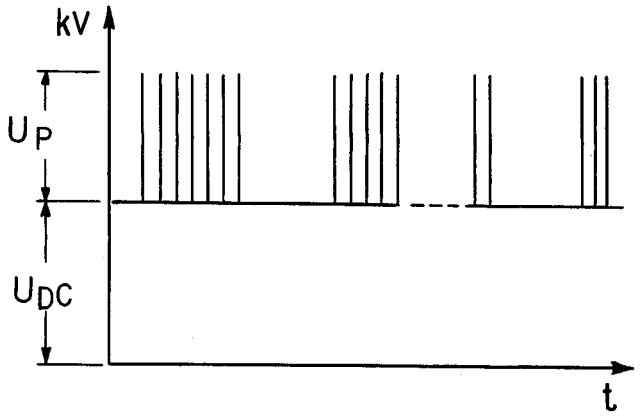
FIG. 4 is another alternate embodiment illustrating schematically in the form of a voltage/time diagram the progress of a DC-corona measuring period on a shortened time scale.

In another embodiment, illustrated in FIG. 4, the increase in DC voltage during measurement is set equal to 0. The pulses are stopped with certain time intervals (selectable for example, between 1 and 10 min), and remain stopped for the time necessary for performing a corona discharge current measurement. This measurement is performed during an even number of half-periods of power frequency. In this version, the DC-voltage is determined preferably by a closed loop control of the measured current. (The current set value is selectable between 0 and maximum precipitator current).

Figure 5:
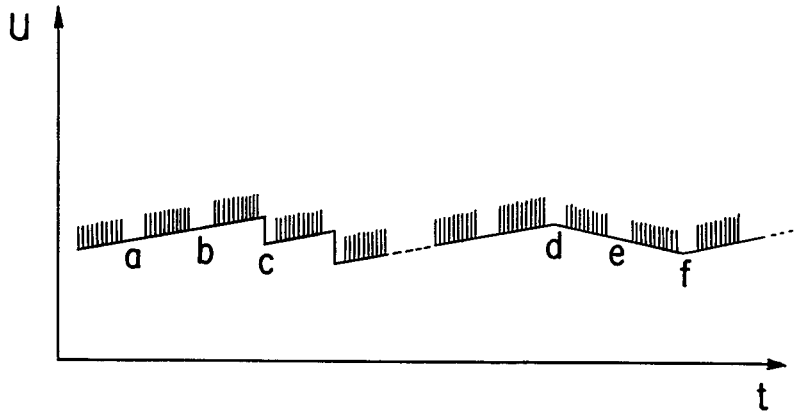
FIG. 5 is still another alternate embodiment illustrating schematically in the form of a voltage/time diagram the progress of a DC-corona measuring period on a shortened time scale.

In still another embodiment as illustrated in FIG. 5, the DC-voltage is continuously increasing very slowly linearly with time (with a slope selectable, for example, from 0 to maximum DC voltage within a period of 0 to 20 min.). In a first (a) and a second (b) measuring period the corona current measured does not exceed the set value. During a third measuring period (c) the set value for the corona current is exceeded. Hereafter, the DC voltage is reduced a certain amount (selectable, for example, between 0,2 and 1kV) and the linear rise is started again from the lower value. Alternatively when the set value is exceeded the continuous increase of the DC-voltage may be turned into a continuous decrease with the same very slight slope as the slope of the previous increase as shown at the measuring period (d). During the next measurement (e) the corona current is still higher than the set value and the decrease of the DC-voltage is continued until a measurement (f) showing a corona current below the set value turns the decrease into an increase.

At start-up, the DC voltage is increased to a certain start value (selectable between 10 and 50kV). Hereafter, the DC voltage is increased linearly with time (with highest possible speed) until the set value of permitted current has been exceeded for the first time. Then the DC voltage is decreased linearly with the same slope until the corona current again is below the permitted set value. Then the voltage pulses are activated and one of the control procedures above is used.

If a spark-over occurs at the DC-voltage between pulses, this may be taken as an indication of the DC-level being too high. Therefore, when such a spark-over is detected the DC-voltage is reduced by a certain amount (selectable for example, between 0 and 6kV) and thereafter increased from this value controlled by one of the methods described above.

A spark-over between pulses may also be taken as an indication of the DC-level being too close to the limit set by the permissible corona discharge current. Therefore, another reaction is to increase the finger or plateau voltage by a certain amount (selectable between 0–10kV).

Combinations of the described embodiments may be used. Accordingly, the "finger-method" may be used in any of the described embodiments, and closed loop control may be used in connection with the "finger-method".

I claim:

1. A method of controlling the DC-voltage in an electrostatic precipitator having electrodes energized by pulses superimposed upon a preset DC-voltage, which comprises:

periodically eliminating said pulses and thereafter measuring a corona discharge current between said electrodes;

comparing said measured corona discharge current against a predetermined value; and selectively adjusting the DC-voltage in accordance with said measured corona discharge current so as to maintain the DC-voltage at approximately the corona extinction voltage by increasing the DC-voltage when the measured discharge current is lower than said predetermined value and by decreasing the DC-voltage when the measured discharge current is higher than said predetermined value.

2. The method according to claim 1 wherein the DC-voltage as a function of time is permanently increased by a slight slope, and the increase is maintained when the discharge current is lower than the predetermined value, and the DC-voltage is decreased by a discrete value if the discharge current measured is higher than the predetermined value.

3. The method according to claim 3 wherein the decrease of the original DC-value due to the controlling is made by a preselected discrete value.

4. The method according to claim 3 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

5. The method according to claim 1 wherein the DC-voltage as a function of time can be selectively in either of a first state and a second state wherein the DC-voltage is permanently increased or decreased respectively with a slight slope, said increase being maintained and said decrease being changed into an increase when the discharge current measured is lower than the predetermined value, and said decrease being maintained and said increase being changed into a decrease when the discharge current measured is higher than the predetermined value.

6. The method according to any of claims 1, 3 and 4 wherein the DC-voltage is temporarily increased by a predetermined amount and maintained at said elevated level during the measuring of the corona current.

7. The method according to claim 5 wherein the pulses are not turned off until the temporary increase of the DC-voltage has been established.

8. The method according to claim 6 wherein the pulses are turned on again towards the end of the period of temporary increased DC-level.

9. The method according to claim 8 wherein said selective increase and decrease of the original DC-voltage due to the controlling are each determined by a closed loop control regulating the DC-voltage to create a predetermined corona current.

10. The method according to claim 8 wherein said selective increase and decrease of the original DC-value due to the controlling is made by a preselected discrete value.

11. The method according to claim 8 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

12. The method according to claim 6 wherein said selective increase and decrease of the original DC-voltage due to the controlling are each determined by a closed loop control regulating the DC-voltage to create a predetermined corona current.

13. The method according to claim 6 wherein said selective increase and decrease of the original DC-value due to the controlling is made by a preselected discrete value.

14. The method according to claim 6 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

15. The method according to claim 5 wherein the pulses are turned on again towards the end of the period of temporary increased DC-level.

16. The method according to claim 7 wherein said selective increase and decrease of the original DC-voltage due to the controlling are each determined by a closed loop control regulating the DC-voltage to create a predetermined corona current.

17. The method according to claim 7 wherein said selective increase and decrease of the original DC-value due to the controlling is made by a preselected discrete value.

18. The method according to claim 7 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

19. The method according to claim 5 wherein said selective increase and decrease of the original DC-voltage due to the controlling are each determined by a closed loop control regulating the DC-voltage to create a predetermined corona current.

20. The method according to claim 5 wherein said selective increase and decrease of the original DC-value due to the controlling is made by a preselected discrete value.

21. The method according to claim 5 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

22. The method according to claim 4 wherein said selective increase and decrease of the original DC-voltage due to the controlling are each determined by a closed loop control regulating the DC-voltage to create a predetermined corona current.

23. The method according to claim 4 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

24. The method according to claim 1 wherein said selective increase and decrease of the original DC-voltage due to the controlling are each determined by a closed loop control regulating the DC-voltage to create a predetermined corona current.

25. The method according to claim 1 wherein said selective increase and decrease of the original DC-value due to the controlling is made by a preselected discrete value.

26. The method according to claim 1 wherein the pulses, when the DC-level is selectively in either of a first state when the DC-level is increasing and a second state when the DC-level is decreasing, are regulated to keep the sum of the DC-voltage and the pulse-voltage constant before and after the measuring period.

* * * * *